US011162380B2

(12) United States Patent
Johanssen et al.

(10) Patent No.: US 11,162,380 B2
(45) Date of Patent: Nov. 2, 2021

(54) VARIABLE GEOMETRY TURBINE

(71) Applicant: Cummins Ltd., Huddersfield (GB)

(72) Inventors: Benjamin Johanssen, Huddersfield (GB); Chris Hollingbery, Huddersfield (GB); Yi (Robert) Zhang, Huddersfield (GB); George Sandford, Huddersfield (GB)

(73) Assignee: Cummins Ltd., Huddersfield (GB)

( * ) Notice: Subject to any disclaimer, the term of this patent is extended or adjusted under 35 U.S.C. 154(b) by 159 days.

(21) Appl. No.: 16/287,274

(22) Filed: Feb. 27, 2019

(65) Prior Publication Data

US 2019/0264576 A1 Aug. 29, 2019

(30) Foreign Application Priority Data

Feb. 27, 2018 (GB) ..... 1803192

(51) Int. Cl.
*F01D 17/14* (2006.01)
*F01D 9/06* (2006.01)
(Continued)

(52) U.S. Cl.
CPC ..... *F01D 17/141* (2013.01); *F01D 9/06* (2013.01); *F01D 17/14* (2013.01); *F01D 17/165* (2013.01);
(Continued)

(58) Field of Classification Search
CPC . F01D 9/06; F01D 9/026; F01D 17/14; F01D 17/141; F01D 17/143;
(Continued)

(56) References Cited

U.S. PATENT DOCUMENTS 4,557,665 A * 12/1985 Szczupak ..... F01D 17/143 415/158
5,941,684 A * 8/1999 Parker ..... F01D 17/143 415/156
(Continued)

FOREIGN PATENT DOCUMENTS

EP 0095853 A1 12/1983
EP 1260676 A1 11/2002
(Continued)

OTHER PUBLICATIONS

Extended Search Report issued by the European Patent Office, dated Jun. 13, 2019 for Application No. EP19159806; 10 pages.
(Continued)

*Primary Examiner* — Courtney D Heinle
*Assistant Examiner* — Sang K Kim
(74) *Attorney, Agent, or Firm* — Faegre Drinker Biddle & Reath LLP

(57) ABSTRACT

A variable geometry turbine is disclosed comprising: a housing; a turbine wheel supported in the housing for rotation about an axis; a movable wall member; a cavity provided in the housing; and an inlet passageway extending radially inwards towards the turbine wheel. The movable wall member comprises a generally annular wall and radially inner and outer flanges extending axially from the generally annular wall, inner surfaces of the generally annular wall and radially inner and outer flanges defining an interior surface of the movable wall member. The cavity is suitable for receipt of the radially inner and outer flanges of the moveable member, the movable wall member being axially movable relative to the housing to vary the extent to which the radially inner and outer flanges of the moveable member are received in the cavity.

18 Claims, 8 Drawing Sheets

(51) Int. Cl.
*F01D 17/18* (2006.01)
*F02B 37/22* (2006.01)
*F01D 17/16* (2006.01)

(52) U.S. Cl.
CPC ..... *F01D 17/167* (2013.01); *F01D 17/18* (2013.01); *F02B 37/225* (2013.01); *F05D 2220/40* (2013.01); *F05D 2230/60* (2013.01)

(58) Field of Classification Search
CPC .. F01D 17/165; F01D 17/167; F05D 2240/12; F05D 2240/40; F05D 2250/40; F05D 2250/41; F02B 37/22
See application file for complete search history.

(56) References Cited

U.S. PATENT DOCUMENTS 6,932,565 B2 * 8/2005 Garrett ..... F01D 5/141 415/119
8,172,516 B2 * 5/2012 Parker ..... F01D 17/143 415/151
8,221,059 B2 * 7/2012 Brown ..... F01D 17/143 415/157
8,291,703 B2 * 10/2012 Garrett ..... F01D 17/167 415/158
9,404,383 B2 * 8/2016 Roberts ..... F01D 17/167
9,650,911 B1 * 5/2017 Luck ..... F01D 17/143
2005/0262841 A1 * 12/2005 Parker ..... F01D 17/14 60/602

FOREIGN PATENT DOCUMENTS

GB 2408779 A 6/2005
GB 2461720 A 1/2010
GB 2462266 A 2/2010
JP S60175707 A 9/1985
WO 03023194 A1 3/2003

OTHER PUBLICATIONS

Examination Report issued by the United Kingdom Intellectual Property Office, dated Jul. 27, 2018, for Application No. GB18031922; 4 pages.

* cited by examiner

VARIABLE GEOMETRY TURBINE

FIELD OF THE DISCLOSURE

The present disclosure relates to a variable geometry turbine, particularly, but not exclusively, for use in a turbocharger of an internal combustion engine.

BACKGROUND

Turbochargers are known devices for supplying air to the intake of an internal combustion engine at pressures above atmospheric pressure (boost pressures). A conventional turbocharger comprises an exhaust gas driven turbine wheel mounted on a rotatable shaft within a turbine housing. Rotation of the turbine wheel rotates a compressor wheel that is mounted on the other end of the shaft and within a compressor housing. The compressor wheel delivers compressed air to the engine intake manifold. The turbocharger shaft is conventionally supported by journal and thrust bearings, including appropriate lubricating systems, located within a central bearing housing connected between the turbine and compressor wheel housings.

In known turbochargers, the turbine comprises a turbine chamber within which the turbine wheel is mounted, an inlet passageway defined between facing radial walls arranged around the turbine chamber, an inlet volute arranged around the inlet passageway, and an outlet passageway extending from the turbine chamber. The passageways and chambers communicate in such a way that pressurised exhaust gas admitted to the inlet volute flows through the inlet passageway to the outlet passageway via the turbine and rotates the turbine wheel. It is also known to trim turbine performance by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suit varying engine demands. For instance, when the volume of exhaust gas being delivered to the turbine is relatively low, the velocity of the gas reaching the turbine wheel is maintained at a level that ensures efficient turbine operation by reducing the size of the inlet passageway.

In one known type of variable geometry turbine, an axially moveable wall member, generally referred to as a "nozzle ring", defines one wall of the inlet passageway. The position of the nozzle ring relative to a facing wall of the inlet passageway is adjustable to control the axial width of the inlet passageway. Thus, for example, as gas flowing through the turbine decreases, the inlet passageway width may also be decreased to maintain gas velocity and to optimise turbine output. Such nozzle rings comprise a generally annular wall and inner and outer axially extending flanges. The flanges extend into a cavity defined in the turbine housing, which is a part of the housing that in practice is provided by the bearing housing, which accommodates axial movement of the nozzle ring.

The nozzle ring may be provided with vanes that extend into the inlet passageway and through slots provided on the facing wall of the inlet passageway to accommodate movement of the nozzle ring. Alternatively, vanes may extend from the fixed wall through slots provided in the nozzle ring. Generally the nozzle ring is supported on rods extending parallel to the axis of rotation of the turbine wheel and is moved by an actuator that axially displaces the rods. Various forms of actuators are known for use in variable geometry turbines, including pneumatic, hydraulic and electric actuators that are mounted externally of the turbocharger and connected to the variable geometry system via appropriate linkages.

When a conventional turbine is in use, with gas passing through the inlet passageway, pressure is applied to the face of the nozzle ring tending to force the nozzle ring into the annular cavity. The actuating mechanism must overcome the effect of any pressure difference across the nozzle ring if the position of the nozzle ring is to be controlled accurately. Moving the nozzle ring closer to the facing wall of the passageway, so as to further reduce the width of the passageway and increase the speed of the air flow, tends to increase the load applied to the face of the nozzle ring by the exhaust gases. Some actuators for turbines, for example electric actuators, are able to provide only a relatively limited force to move a nozzle ring when compared to pneumatic actuators. In some operating conditions, the force needed to be supplied by the actuator can exceed the capability of the actuator. Furthermore, it is also desirable to ensure that the resultant force on the nozzle ring is unidirectional.

It is known to provide balance apertures in the nozzle ring to reduce pressure differences across the nozzle ring and thereby to reduce the load applied to the face of the nozzle ring. For example, EP0654587 discloses a variable geometry turbine with pressure balance apertures in the nozzle ring between nozzle vanes. The forces on the nozzle ring are created by the pressure on the nozzle ring face, the pressure in the cavity behind the nozzle ring, and by the actuator. The function of the pressure balance apertures is to ensure that the cavity behind the nozzle ring is at a pressure substantially equal to, but always slightly less than, the pressure acting on the front face of the nozzle ring to ensure a small but unidirectional force on the nozzle ring. The turbine nozzle ring is provided with an annular array of vanes extending across the turbine inlet such that air flowing through the inlet flows radially between adjacent vanes that can be regarded as defining a vane passage. The turbine inlet has a reduced radial flow area in the region of the vane passage with the effect that the inlet gas speed increases through the vane passage with a corresponding drop in pressure in this region of the nozzle ring. Accordingly, the pressure balance holes as described in EP0654587 are located between vanes in the sense that the inner and/or outer extremity of each balance aperture lies within the inner or outer radial extent of the nozzle guide vane passage.

It may be desirable to provide a variable geometry turbine that at least partially addresses one or more problems associated with known variable geometry turbines, whether identified herein or otherwise.

SUMMARY

According to a first aspect of the present disclosure there is provided a variable geometry turbine comprising: a housing; a turbine wheel supported in the housing for rotation about an axis, a movable wall member comprising a generally annular wall and radially inner and outer flanges extending axially from the generally annular wall; a cavity provided in the housing for receipt of the radially inner and outer flanges of the moveable member, the movable wall member being axially movable relative to the housing to vary the extent to which the radially inner and outer flanges of the moveable member are received in the cavity, the cavity being defined by radially inner and outer curved side surfaces and a base surface extending between the radially inner and outer curved side surfaces; an inlet passageway extending radially inwards towards the turbine wheel and defined between a face of the generally annular wall of the movable wall member and an opposing wall of the housing, such that said axial movement of the movable wall member relative to the housing varies the axial width of the inlet passageway; and a plurality of axially extending apertures provided through the generally annular wall of the moveable member, such that the inlet and the cavity are in fluid communication via the plurality of apertures; wherein a profile shape of the base surface generally matches a profile shape of an interior surface of the movable wall member.

The axially extending apertures may be referred to as balance apertures in the moveable wall member and, in use, they serve to reduce pressure differences across the generally annular wall of the movable wall member and thereby reduce loads applied to the face of the generally annular wall of the movable wall member. The moveable wall member may be moveable between a fully opened position and a fully closed position. When disposed in the fully opened position, a portion of the base surface of the cavity may contact a portion of the movable wall member.

Since the profile shape of the base surface generally matches the profile shape of the interior surface of the movable wall member, the volume within the cavity which can be filled with gas is significantly reduced with respect to known arrangements. For example, in known arrangements the cavity is typically formed as a generally annular channel extending axially into an axially facing surface of the housing, comprising: a radially inner curved wall, a radially outer curved wall and a generally flat base wall. Similarly, in known arrangements the interior surface of the movable wall member is typically defined by a generally annular channel defined by an inner surface of the radially inner flange, an inner surface of the radially outer flange and a generally flat inner surface of the generally annular wall. In addition, the interior surface of the movable wall member is typically further defined by two supports. These supports, in the form of push rods, are typically attached to the inner surface of the generally annular wall and typically extend through apertures in the generally flat base wall of the cavity for connection to an actuation mechanism. With such a prior art arrangement, the base surface of the cavity is generally flat and the interior surface of the movable wall member is partly defined by a generally flat inner surface of the generally annular wall, in combination with the two supports. Therefore, with such a prior art arrangement, when the moveable wall member is disposed in the fully opened position, apart from the space taken up by the two support, the entire volume of the generally annular channel defined by inner surfaces of the radially inner flange, the radially outer flange and the generally annular wall can be filled with gas.

Therefore, the variable geometry turbine according to the first aspect of the disclosure provides of an arrangement with balance apertures that can reduce pressure differences across the movable wall member (i.e. pressure differences between the gas flow through the inlet and the cavity in the housing) whilst reducing the available volume that can support gas within the cavity. This is particularly advantageous for situations which, in use, will encounter large fluctuations of pressure within the inlet, as now discussed.

It is known that for a turbocharger that is, in use, connected to an engine the exhaust gas that flows through the turbine (which may be, for example, a variable geometry turbine) will comprise a plurality of pulses, each pulse originating from a different cylinder of the engine. As a result, the pressure within the turbine inlet fluctuates due to the timing of the exhaust pulses received from the exhaust manifold of the vehicle engine. This pressure fluctuation is present both when the turbocharger is operating in an engine "fired" mode and also an engine "braking" mode. For instance, in braking mode the pressure fluctuation can give rise to an undesirable fluctuation in the braking torque produced. The terms "fired" mode and "braking" mode are well known to the ordinarily skilled artisan in this field.

The inventors of the present disclosure have realised that for such a time varying pressure in the turbine inlet, although the balance apertures in the movable wall member allow the pressure in the cavity behind the movable wall member to equalise the local pressure in the inlet proximate to the balance apertures, there is a time lag between the pressure in the cavity and the local pressure in the inlet proximate to the balance apertures. It will be appreciated that the average pressure in the cavity behind the movable wall member will be substantially equal to the local average pressure in the inlet proximate to the balance apertures. However, as the instantaneous pressure in the inlet proximate to the balance apertures varies with time (due to the timing of the exhaust pulses), the instantaneous pressure in the cavity behind the movable wall member also vary with time in a similar way but with a lag (or phase difference) with respect to the instantaneous pressure in the inlet proximate to the balance apertures. For sufficiently high frequency pressure variations this time lag can result in large time varying loads being applied to the movable wall member (which loads must be overcome by the actuating mechanism in order to accurately control position of the movable wall member). Furthermore, the inventors of the present disclosure have realised that this time lag (which represents the time taken to fill or evacuate the cavity to equalise pressure across the balance apertures) is dependent on the volume of the cavity which is filled with gas.

Since the profile shape of the base surface generally matches the profile shape of the interior surface of the movable wall member, the volume within the cavity of the variable geometry turbine according to the first aspect of the disclosure which can be filled with gas is significantly reduced with respect to known arrangements. In turn, advantageously, this reduces the magnitude of the peak to peak variation in the loads that are applied to the movable wall member and which must be overcome by the actuating mechanism in order to accurately control position of the movable wall member.

Furthermore, the variable geometry turbine according to the first aspect of the disclosure reduces the magnitude of the time varying loads that are applied to the movable wall member and which must be overcome by the actuating mechanism without adversely affecting the efficiency of the turbine. In fact, the variable geometry turbine according to the first aspect of the disclosure can reduce the magnitude of these time varying loads and, in addition, may increase the efficiency of the turbine over known arrangements, as now discussed.

The turbine nozzle ring is usually provided with an array of vanes extending across the turbine inlet. Air flowing through the inlet flows radially between adjacent vanes that can therefore be regarded as defining a vane passage. The turbine inlet has a reduced radial flow area in the region of the vane passage with the effect that the inlet gas speed increases through the vane passage with a corresponding drop in pressure in this region of the nozzle ring. Accordingly, the pressure balance holes as described in EP0654587 are located between vanes in the sense that the inner and/or outer radial extremity of each balance aperture lies within the inner or outer radial extent of the nozzle guide vane passage.

It has been previously found that even with the provision of pressure balance holes as disclosed in EP0654587, the force on the nozzle ring can fluctuate undesirably as the pressure within the turbine inlet fluctuates due to exhaust pulses being released into the exhaust manifold of the vehicle engine. In order to reduce the magnitude of load variations on the movable wall member produced by these pressure fluctuations, in EP1888881 it has been proposed to provide, in combination with the balance apertures taught in EP0654587 (herein referred to as primary balance apertures), additional balance apertures (herein referred to as peripheral balance apertures) either upstream or downstream of the primary balance apertures. In particular, the provision of peripheral balance apertures upstream of (i.e. at a larger radius than) the primary balance apertures can result in a reduction in the force amplitude at the actuator interface caused by an exhaust pulse passing through the turbine stage when compared with the provision of primary pressure balance apertures, alone.

However, the variable geometry turbine according to the first aspect of the disclosure has a number of advantages over the arrangement disclosed in EP1888881, as now discussed.

It will be appreciated that as gas flows through the inlet passageway the pressure of the gas flow drops as it moves across the face of the nozzle ring towards the turbine wheel. Therefore, by selecting a particular radial position for the balance apertures, an average pressure within the cavity (which will be substantially equal to the local average pressure in the inlet proximate to the balance apertures) can be maintained. The provision of peripheral balance apertures upstream of (i.e. at a larger radius than) the primary balance apertures will have the effect of increasing the average pressure within the cavity behind the movable wall member. In turn, this reduces the range of average pressures that can be achieved by selection of a radial position of the primary balance apertures. Put differently, once the peripheral balance apertures have been added, in order to achieve the same average pressure within the cavity behind the movable wall member as was achieved without them, the primary balance apertures have to be moved to a lower pressure region (i.e. to a small radius with respect to the turbine axis).

Furthermore, in contrast the variable geometry turbine according to the first aspect of the disclosure may not need such secondary balance apertures or, alternatively, may be provided with fewer such secondary balance apertures. It will be appreciated that such secondary balance apertures represent a leak path within the turbine. Therefore, since the variable geometry turbine according to the first aspect of the disclosure does not need such secondary balance apertures the efficiency of the turbine will be increased relative to this prior art arrangement (as taught by EP1888881). In fact, since the profile shape of the base surface generally matches the profile shape of the interior surface of the movable wall member, the volume within the cavity which can be filled with gas is significantly reduced with respect to known arrangements. With such a reduced volume within the cavity which can be filled with gas, a smaller total area of the balance apertures can be used with respect to known turbines to achieve the same level of balancing. In turn, this can result in an increase in the efficiency of the turbine with respect to the arrangement of EP0654587 and a further increase in efficiency with respect to the arrangement of EP1888881.

The interior surface of the movable wall member may be at least partially defined by inner surfaces of the generally annular wall and the radially inner and outer flanges.

The movable wall member may further comprise at least one support. For example, the movable wall member may comprise two supports, each support being of the form of a push rod. The interior surface of the movable wall member may be at least partially defined by said at least one support and any connecting members or connecting portions of said at least one support. For example, each support may be connected to a main body of the movable wall member (which may be referred to as a nozzle ring) via an arcuate connecting member. Said connecting members and supports at least partially define the interior surface of the movable wall member.

At least part of the base surface of the cavity and at least part of the interior surface of the movable wall member may be not flat.

One of the base surface of the cavity and the interior surface of the movable wall member may be at least partially generally concave and the other may be at least partially generally convex. It may be that the generally convex shape can be partially received within the generally concave shape.

The base surface of the cavity may comprise at least one arcuate radially central portion which is shaped so as to be received in an interior of the moveable wall member when it is disposed in a fully open position.

Each arcuate radially central portion may be of the form of an axial protrusion from a generally flat portion of the base surface.

The number of arcuate radially central portions may be dependent on the number of supports (for example push rods) that the movable wall member has. Each arcuate radially central portion may extend circumferentially generally between apertures that supports of the movable wall member extend through.

Along its circumferential extent, each arcuate radially central portion may comprise two end portions and a central portion disposed there between. The axial extent of the central portion may be greater than that of the two end portions. Adjacent end portions of two arcuate radially central portions may be separated by an aperture through which a support of the movable wall member extends and the reduced axial extent of two end portions relative to the central portion may form a void that accommodates a connecting member or portion of said support.

The movable wall member may support an array of circumferentially spaced inlet vanes each of which extends across the inlet passageway. At least some of the axially extending apertures provided through the generally annular wall of the moveable member may be located between the inlet vanes.

The moveable wall member may be moveable between a fully open position and a fully closed position. When disposed in the fully open position, part of the moveable member may contact part of the base surface of the cavity. For example, when disposed in the fully open position, the radially inner and outer flanges of the moveable member may contact a portion of the base surface of the cavity.

The base surface of the cavity and the interior surface of the movable wall member may be formed from materials that are impermeable to gas flow.

The shape of the base surface of the cavity and the profile shape of the interior surface of the movable wall member may be such that the volume of the cavity is reduced by at least 20% relative to an arrangement wherein the base surface of the cavity and the interior surface of the generally annular wall were both flat.

According to a second aspect of the present disclosure there is provided a turbocharger comprising the variable geometry turbine according to the first aspect of the disclosure.

According to a third aspect of the present disclosure there is provided a method of forming a variable geometry turbine comprising: providing a movable wall member comprising a generally annular wall and radially inner and outer flanges extending axially from the generally annular wall; providing a housing having a cavity for receipt of the radially inner and outer flanges of the moveable member, the cavity being defined by radially inner and outer curved side surfaces and a base surface extending between the radially inner and outer curved side surfaces; mounting the movable wall member in the cavity of the housing such that the movable wall member is axially movable relative to the housing to vary the extent to which the radially inner and outer flanges of the moveable member are received in the cavity; mounting a turbine wheel in the housing for rotation about an axis, such that a face of the generally annular wall of the movable wall member and an opposing wall of the housing define an inlet passageway extending radially inwards towards the turbine wheel; and wherein a plurality of axially extending apertures are provided through the generally annular wall of the moveable member, such that the inlet and the cavity are in fluid communication via the plurality of apertures; and wherein a profile shape of the base surface generally matches a profile shape of an interior surface of the movable wall member.

The variable geometry turbine formed according to the third aspect of the disclosure may have any of the features of the variable geometry turbine according to the first aspect of the disclosure as desired.

Providing the housing having the cavity may comprise casting a part of the housing on which the cavity is formed. The part of the housing on which the cavity is formed may be a bearing housing.

Providing the housing having the cavity may further comprise machining the casting to form at least a part of the cavity.

Additionally or alternatively, providing the housing having the cavity may further comprise attaching to the casting one or more additional members, the one or more additional members contributing to the profile shape of the base surface of the cavity.

BRIEF DESCRIPTION OF THE DRAWINGS

Specific embodiments of the present disclosure will now be described, by way of example, with reference to the accompanying drawings, of which.

DETAILED DESCRIPTION OF EMBODIMENTS OF THE DISCLOSURE

An embodiment of a turbocharger 1 incorporating a variable geometry turbine in accordance with an embodiment of the present disclosure is now described with reference to FIGS. 1, 2*a*, 3*a*, 3*b* and 4*a*.

Figure 1:
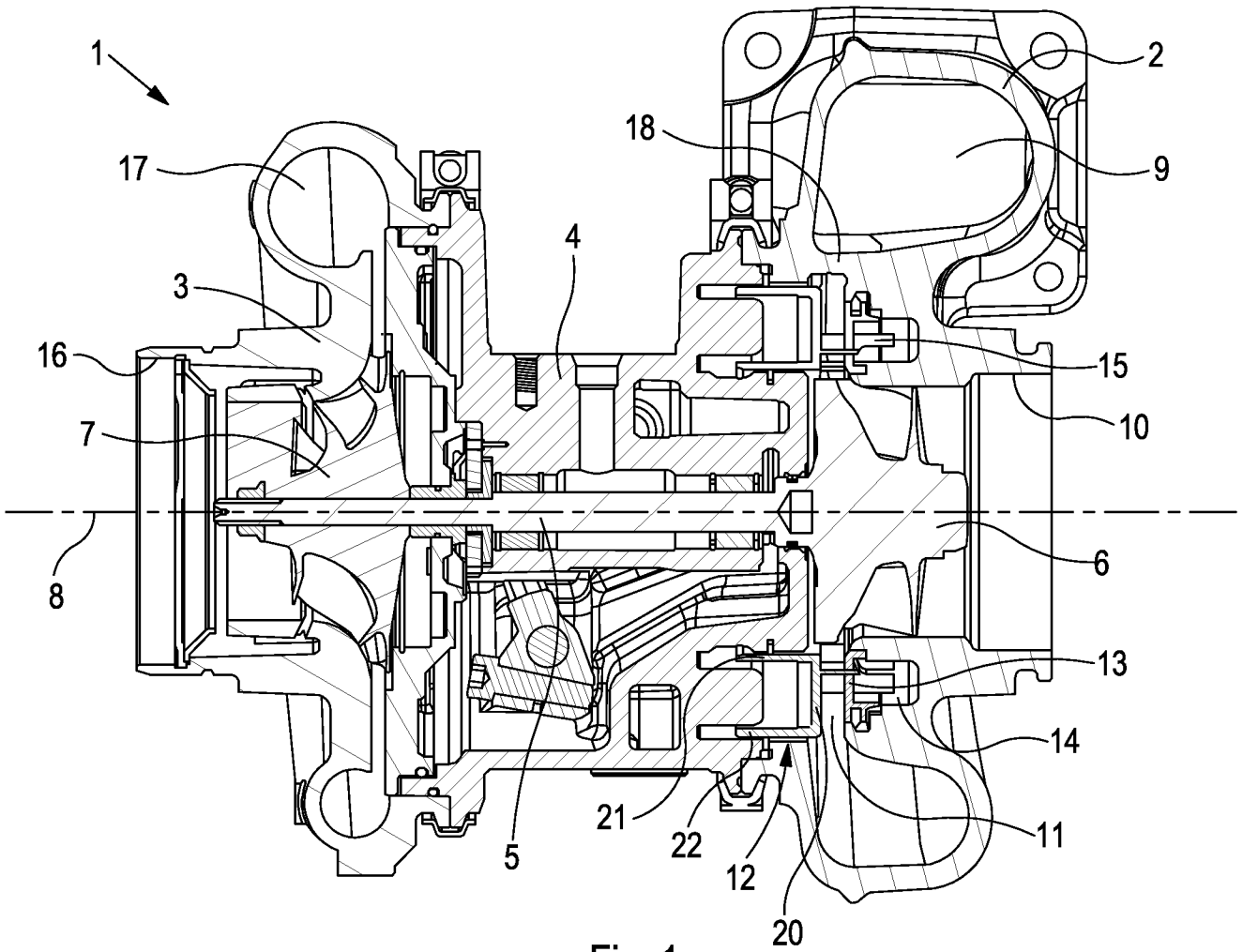
FIG. 1 is a cross-section of a turbocharger incorporating a variable geometry turbine in accordance with an embodiment of the present disclosure.

FIG. 1 shows a turbocharger 1 incorporating a variable geometry turbine in accordance with an embodiment of the present disclosure. The turbocharger 1 comprises a turbine housing 2 and a compressor housing 3 interconnected by a central bearing housing 4. A turbocharger shaft 5 extends from the turbine housing 2 to the compressor housing 3 through the bearing housing 4. A turbine wheel 6 is mounted on one end of the shaft 5 for rotation within the turbine housing 2, and a compressor wheel 7 is mounted on the other end of the shaft 5 for rotation within the compressor housing 3. The shaft 5 rotates about turbocharger axis 8 on bearing assemblies located in the bearing housing 4.

It will be appreciated that the turbine housing 2 and an axial end of the bearing housing 4 together form a housing of the variable geometry turbine, in which the turbine wheel 6 is supported for rotation about turbocharger axis 8.

The turbine housing 2 defines an inlet volute 9 to which exhaust gas from an internal combustion engine (not shown) is delivered. The exhaust gas flows from the inlet volute 9 to an axial outlet passage 10 via an inlet passageway 11 and the turbine wheel 6. The inlet passageway 11 is defined between two axially spaced walls. In particular, the inlet passageway 11 is defined on one side by a face of a movable wall member 12, commonly referred to as a "nozzle ring," and on the opposite side by a shroud 13. The shroud 13 covers the opening of a generally annular recess 14 in the turbine housing 2.

As will be appreciated by the skilled person, the inlet volute 9 may comprise a generally toroidal volume (defined by the turbine housing 2) and an inlet arranged to direct exhaust gas from an internal combustion engine tangentially into the generally toroidal volume. As exhaust gas enters the inlet volute 9 it flows circumferentially around the generally toroidal volume and radially inwards towards the inlet passageway 11. In the vicinity of the inlet, there is provided a wall or "tongue" 18 which serves to separate the generally toroidal volume in the vicinity of the inlet of the volute 9 from the inlet passageway 11 of the turbine. The tongue 18 may help to guide the exhaust gas circumferentially around the generally toroidal volume and may also aid the mixing of the generally linear gas flowing into the volute 9 with the circumferential gas flow around the generally toroidal volume. In the cross section shown in FIG. 1, the tongue 18 is visible on one side of the axis 8 only.

Figure 3B:
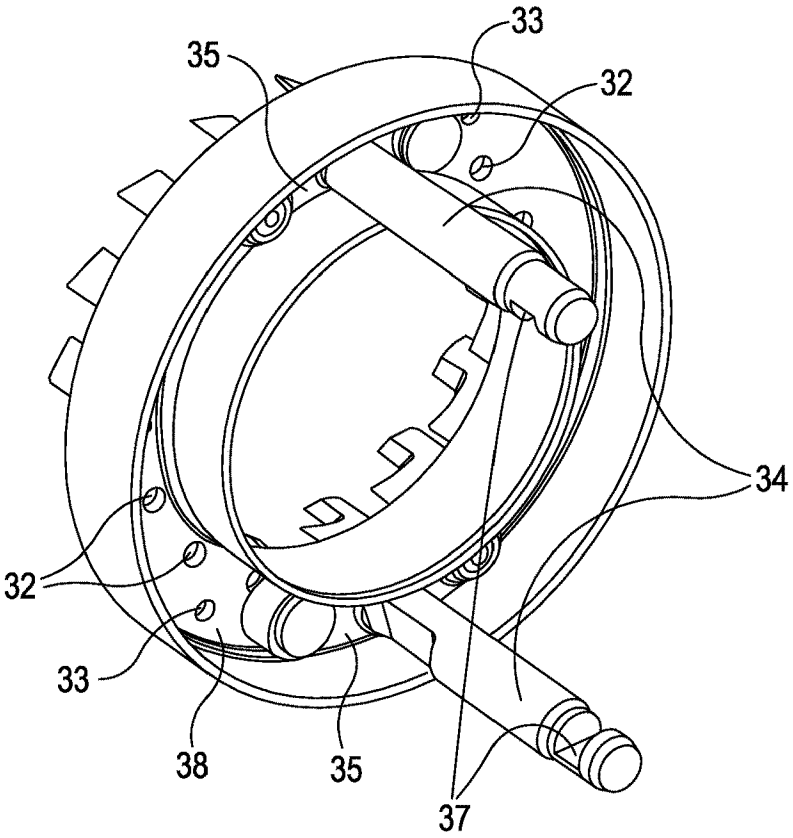
FIG. 3*b* is a second perspective view of the movable wall member shown in FIGS. 1 and 2*a;*
Figure 3A:
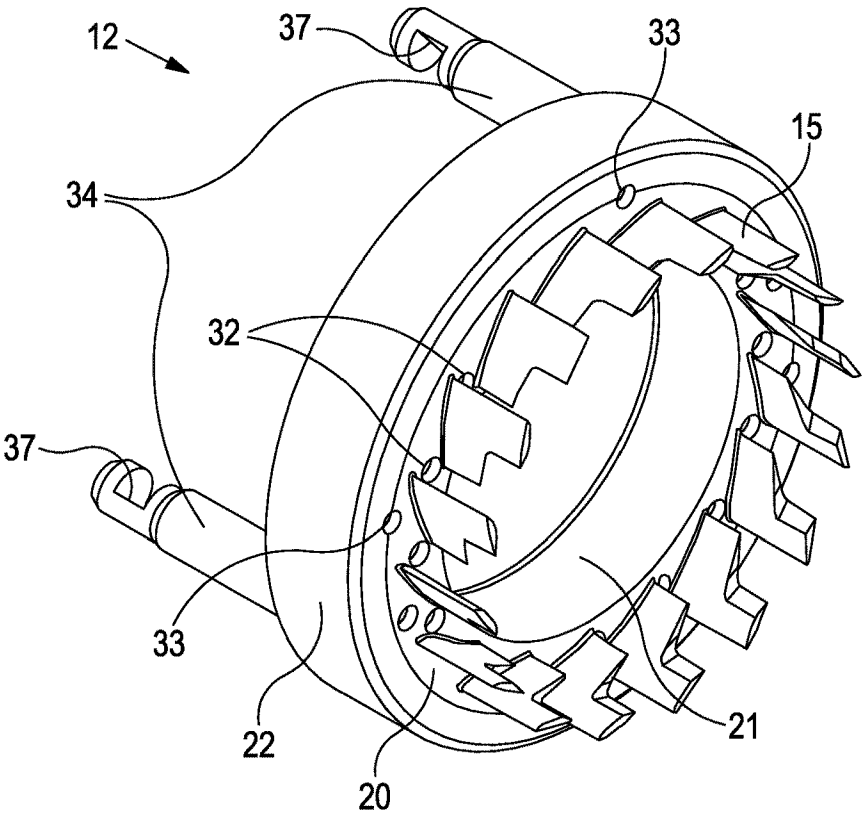
FIG. 3*a* is a first perspective view of the movable wall member shown in FIGS. 1 and 2*a;*

FIGS. 3*a* and 3*b* show two different perspective views of the movable wall member 12.

The movable wall member 12 supports an array of circumferentially and equally spaced inlet vanes 15 each of which extends across the inlet passageway 11. The vanes 15 are orientated to deflect gas flowing through the inlet passageway 11 towards the direction of rotation of the turbine wheel 6. The shroud 13 is provided with suitably configured slots for receipt of the vanes 15 such that as the movable wall member 12 moves axially towards the shroud 13, a distal end of each of the vanes 15 moves through one of said slots and protrudes into the recess 14.

Accordingly, by appropriate control of the actuator (which may for instance be pneumatic or electric), the axial position of the movable wall member 12 can be controlled. The speed of the turbine wheel 6 is dependent upon the velocity of the gas passing through the inlet passageway 11. For a fixed rate of mass of gas flowing into the inlet passageway 11, the gas velocity is a function of the width of the inlet passageway 11, the width being adjustable by controlling the axial position of the movable wall member 12. As the width of the inlet passageway 11 is reduced, the velocity of the gas passing through it increases. FIG. 1 shows the nozzle ring 12 disposed between a fully open position and a fully closed position such that the width of inlet passageway 11 is greater that a minimum width and smaller than a maximum width.

Gas flowing from the inlet volute 9 to the outlet passage 10 passes over the turbine wheel 6 and as a result torque is applied to the shaft 5 to drive the compressor wheel 7. Rotation of the compressor wheel 7 within the compressor housing 2 pressurises ambient air present in an air inlet 16 and delivers the pressurised air to an air outlet volute 17 from which it is fed to an internal combustion engine (not shown).

The movable wall member (or nozzle ring) 12 comprises a generally annular wall 20 and radially inner and outer flanges 21, 22 extending axially from the generally annular wall 20.

Figure 4A:
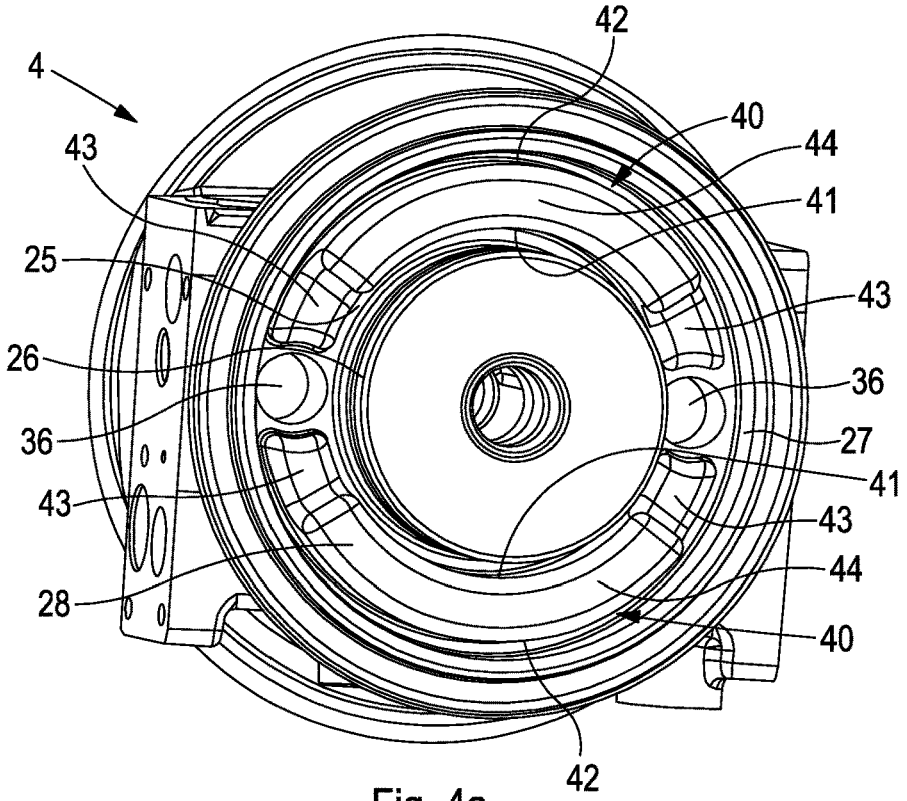
FIG. 4*a* is a perspective view of an axial end of the bearing housing of the turbocharger shown in FIGS. 1 and 2*a*, which defines a cavity for receipt of radially inner and outer flanges of the moveable member.

A cavity 25 is provided in the housing of the variable geometry turbine for receipt of the radially inner and outer flanges 21, 22 of the moveable member 12. It will be appreciated that the cavity 25 is formed on an axial end of the bearing housing 4, which cooperates with the turbine housing 2 to form the housing of the variable geometry turbine. FIG. 4*a* shows a perspective view of the axial end of the bearing housing 4 of the turbocharger 1, which defines the cavity 25.

As the movable wall member 12 moves axially, the extent to which the radially inner and outer flanges 21, 22 of the moveable member 12 are received in the cavity 25 varies. The cavity 25 is defined by radially inner and outer curved side surfaces 26, 27 and a base surface 28 extending between the radially inner and outer curved side surfaces 26, 27. The moveable wall member 12 is moveable between a fully opened position and a fully closed position. When disposed in the fully opened position, the radially inner and outer flanges 21, 22 of the moveable member 12 may contact a portion of the base surface 28 of the cavity 25. That is, a portion of the base surface 28 of the cavity 25 may serve as a physical stop to limit the range of axial movement of the moveable member 12.

Inner and outer sealing rings 30 and 31 are provided to seal the movable wall member 12 with respect to inner and outer curved surfaces 26, 27 of the cavity 25 respectively, whilst allowing the movable wall member 12 to slide within the cavity 25. The inner sealing ring 30 is supported within an annular groove formed in the radially inner curved surface 30 of the cavity 25 and bears against the inner flange 21 of the movable wall member 12. The outer sealing ring 31 is supported within an annular groove formed in the radially outer curved surface 27 of the cavity 25 and bears against the outer flange 22 of the movable wall member 12.

As can be seen in FIGS. 3*a* and 3*b*, a plurality of axially extending apertures 32, 33 provided through the generally annular wall 20 of the moveable wall member 12. The apertures 32, 33 may be referred to as balancing apertures 32, 33. The apertures 32, 33 connect the inlet 11 to the cavity 25, such that the inlet 11 and the cavity 25 are in fluid communication via the apertures 32, 33. In use, the apertures 32, 33 serve to reduce pressure differences across the generally annular wall 20 of the movable wall member 12 and thereby reduce loads applied to the face of the generally annular wall 20 of the movable wall member 12.

It will be appreciated that as gas flows through the inlet passageway 11 the pressure of the gas flow drops as it moves across the face of the movable wall member 12 towards the turbine wheel 6. Therefore, by selecting a particular radial position for the balance apertures 32, 33, an average pressure within the cavity 25 (which will be substantially equal to the local average pressure in the inlet 11 proximate to the balance apertures 32, 33) can be maintained.

In use, as air flows radially inwards through the turbine inlet 11, it flows between adjacent vanes 15, which can be regarded as defining a vane passage. The turbine inlet 11 has a reduced radial flow area in the region of the vane passage with the effect that the inlet gas speed increases through the vane passage with a corresponding drop in pressure in this region of the movable wall member 12. Accordingly, a first set of balancing aperture 32 are located between pairs of adjacent vanes 15 in the sense that the inner and outer radial extremity of these balancing apertures 12 lie within the inner or outer radial extent of the vane passage. In this embodiment, a balancing aperture 32 is located between each pair of adjacent vanes 15.

In addition, in this embodiment, a smaller number of balancing apertures 33 are provided upstream of (i.e. at a larger radius than) the balance apertures 32 located between pairs of adjacent vanes 15. These balance apertures 33 can result in a reduction in the force amplitude at the actuator interface caused by an exhaust pulse passing through the inlet passageway 11 when compared with the provision of the balance apertures 32 located between pairs of adjacent vanes 15 alone. As discussed further below, the profile shape of the base surface 28 of the cavity 25 generally matches an interior surface of the movable wall member 12, which also reduces the magnitude of the time varying loads that are applied to the movable wall member 12. Therefore, it will be understood that although the described embodiment comprises balance apertures 33 that are upstream of the balance apertures 32 located between pairs of adjacent vanes 15, these balance apertures 33 are optional. In other, alternative embodiments, these apertures 33 may be absent.

The movable wall member 12 further comprises two supports 34, each of the supports being generally of the form of a shaft or rod. The two supports 34 may be referred to as push rods. Each of the two supports 34 is attached to the inner surface of the generally annular wall 20 (i.e. the surface that is distal from the inlet 11) via an arcuate connecting member 35. The connection between each of the two supports 34 and the inner surface of the generally annular wall 20 may, for example, be generally of the form described in EP0917618.

The supports 34 extend through apertures 36 in the base surface 23 of the cavity 25 for connection to an actuation mechanism. The position of the movable wall member 12 is controlled by an actuator assembly, which may be generally of the type disclosed in U.S. Pat. No. 5,868,552. An actuator (not shown) is operable to adjust the position of the movable wall member 12 via a mechanical linkage. For example, an actuator may be connected by a lever system to a bar upon which a generally C-shaped yoke is mounted. The ends of the generally C-shaped yoke may engage with the two supports 34 via notches 37.

Inner surfaces of the generally annular wall 20 and radially inner and outer flanges 21, 22 define an interior surface 38 of the movable wall member 12.

The interior surface 38 of the movable wall member 12 is defined by a generally annular channel defined by an inner surface of the radially inner flange 21, an inner surface of the radially outer flange 22 and a generally flat inner surface of the generally annular wall 20. In addition, the interior surface 38 of the movable wall member is further defined by the two supports 34 and the two arcuate connecting members 35.

As can be best seen from FIGS. 3*b* and 4*a*, a profile shape of the base surface 23 of the cavity 25 in the housing of the variable geometry turbine generally matches a profile shape of the interior surface 38 of the movable wall member 12.

In order to achieve this, the base surface 28 extending between the radially inner and outer curved side surfaces 26, 27 is not flat. Rather, the base surface comprises two arcuate radially central portions 40 which are shaped so as to be received in the interior of the moveable wall member 12 when it is disposed in the fully opened position. Each arcuate radially central portion 40 is of the form of an axial protrusion from a generally flat portion 39 of the base surface 28 at an axial end surface of the bearing housing 4. Each arcuate radially central portion 40 is defined by radially inner and outer curved surfaces 41, 42. Each arcuate radially central portion 40 extends circumferentially generally between the two apertures 36 that the supports 34 extend through.

When disposed in the fully opened position, the radially inner flange 21 of the moveable member 12 is received in a groove formed between the radially inner curved side surface 26 of the cavity 25 and radially inner curved surface 41 of the arcuate radially central portion 40. Similarly, when disposed in the fully opened position, the radially outer flange 22 of the moveable member 12 is received in a groove formed between the radially outer curved side surface 27 of the cavity 25 and radially outer curved surface 42 of the arcuate radially central portion 40. When disposed in the fully opened position, the radially inner and outer flanges 21, 22 of the moveable wall member 12 contact the flat portion 39 of the base surface 28 of the cavity 25. That is, this flat portion 39 of the base surface 28 of the cavity 25 serves as a physical stop to limit the range of axial movement of the moveable member 12. Although in this embodiment, the flat portion 39 of the base surface 28 of the cavity 25 serves as a physical stop to limit the range of axial movement of the moveable member 12, it will be appreciated that in alternative embodiments, any other part of the base surface 28 of the cavity 25 may serve as a physical stop to limit the range of axial movement of the moveable member 12. For example, in some embodiments, when the movable wall member 12 is disposed in the fully opened position, the generally annular wall 20 may contact the arcuate radially central portions 40. In general, when disposed in the fully opened position, part of the moveable wall member 12 may contact part of the base surface 28 of the cavity 25.

Along its circumferential extent, each arcuate radially central portion 40 comprises two end portions 43 and a central portion 44 disposed therebetween. The axial extent of the central portion 44 is greater than that of the two end portions 43. The adjacent end portions 43 of the two arcuate radially central portions 40 are separated by one of the apertures 36 that the supports 34 extend through. It will be appreciated that the reduced axial extent of two end portions 43 (relative to the central portion 44) forms a void that accommodates the arcuate connecting members 35 that facilitate the connection between the two supports 34 and the inner surface of the generally annular wall 20.

Figure 2B:
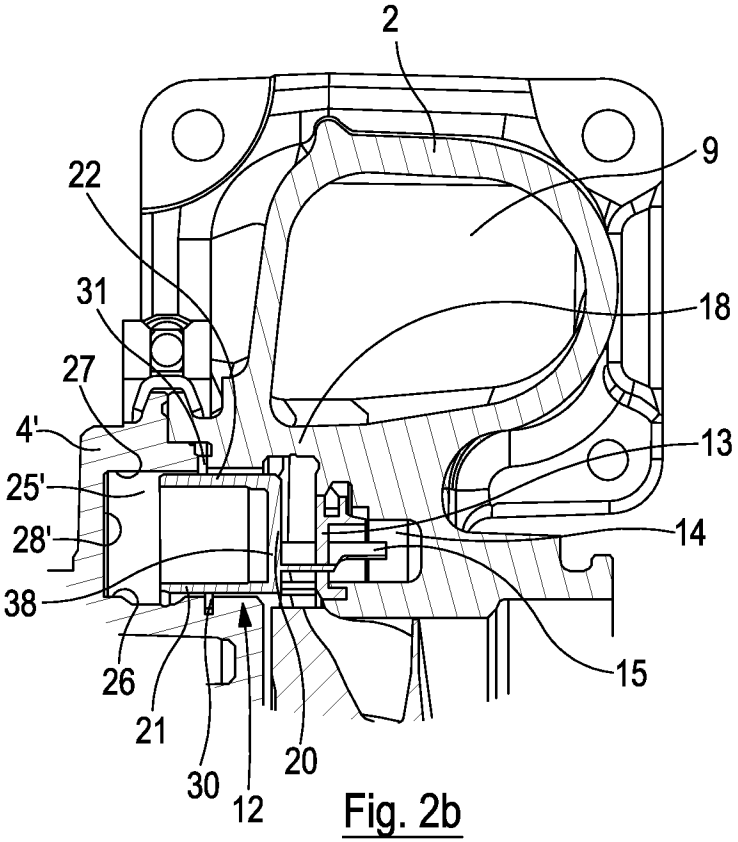
FIG. 2*b* is a cross-section similar to that shown in FIG. 2*a* but showing details of a known movable wall member and cavity.
Figure 4B:
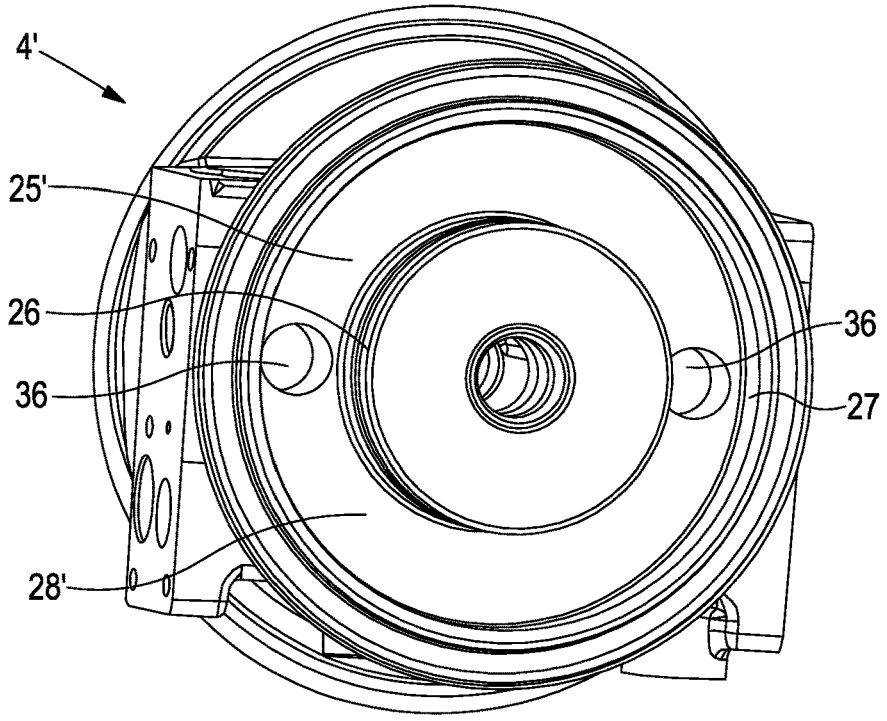
FIG. 4*b* is a perspective view of an axial end of the bearing housing of the known turbocharger shown in FIG. 2*b*, which defines a cavity for receipt of radially inner and outer flanges of a moveable member.

Since the profile shape of the base surface 23 of the cavity 25 generally matches the profile shape of the interior surface 38 of the movable wall member 12, the volume within the cavity 25 which can be filled with exhaust gas is significantly reduced with respect to known arrangements. This is now discussed with reference to FIGS. 2*b* and 4*b*, which show, respectively, an enlarged portion of a cross-section of a known turbocharger and a perspective view of an axial end of the bearing housing of the known turbocharger. In FIGS. 2*b* and 4*b* features that are generally equivalent to and substantially the same as features of the turbocharger 1 according to an embodiment of the present disclosure have the same reference numerals (and will not be described further here). In FIGS. 2*b* and 4*b* features that generally correspond to features of the turbocharger 1 according to an embodiment of the present disclosure but which differ from those corresponding features have the same reference numerals but with a prime (for example bearing housing 4' generally corresponds to but is different from bearing housing 4).

As shown in FIGS. 2*b* and 4*b*, in known arrangements the cavity 25' is typically formed as a generally annular channel extending axially into an axially facing surface of the bearing housing 4', comprising: a radially inner curved wall 26, a radially outer curved wall 27 and a generally flat base wall 28'. Therefore, with such a prior art arrangement, when the moveable wall member 12 is disposed in the fully opened position (in which the distal ends of the radially inner and outer flanges 21, 22 may be in contact with the generally flat base wall 28'), apart from the space taken up by the two supports 34 and the two arcuate connecting members 35, the entire volume of the generally annular channel defined by inner surfaces of the radially inner flange 21, the radially outer flange 22 and the generally annular wall 20 can be filled with gas.

Therefore, the turbocharger 1 that incorporates a variable geometry turbine according to an embodiment of the disclosure provides of an arrangement with balance apertures 32, 33 that can reduce pressure differences across the movable wall member 12 (i.e. pressure differences between the gas flow through the inlet 11 and the cavity 25 in the housing) whilst reducing the available volume that can support gas within the cavity 25. This is particularly advantageous for situations which, in use, will encounter large fluctuations of pressure within the inlet 11, as now discussed.

In use, the exhaust gas that flows through the turbine inlet 11 will comprise a plurality of pulses, each pulse originating from a different cylinder of the engine. As a result, the pressure within the turbine inlet 11 fluctuates due to these timing of the exhaust pulses received from the exhaust manifold of the vehicle engine. This pressure fluctuation is present both when the turbocharger is operating in an engine "fired" mode and also an engine "braking" mode.

The inventors of the present disclosure have realised that for such a time varying pressure in the turbine inlet 11, although the balance apertures 32, 33 in the movable wall member 12 allow the pressure in the cavity 25 behind the movable wall member 12 to equalise the local pressure in the inlet 11 proximate to the balance apertures 32, 33, there is a time lag between the pressure in the cavity 25 and the local pressure in the inlet 11 proximate to the balance apertures 32, 33. It will be appreciated that the average pressure in the cavity 25 behind the movable wall member 12 will be substantially equal to the local average pressure in the inlet 11 proximate to the balance apertures 32, 33. However, as the instantaneous pressure in the inlet 11 proximate to the balance apertures 32, 33 varies with time (due to the timing of the exhaust pulses), the instantaneous pressure in the cavity 25 behind the movable wall member 12 also varies with time in a similar way but with a lag (or phase difference) with respect to the instantaneous pressure in the inlet 11 proximate to the balance apertures 32, 33. For sufficiently high frequency pressure variations this time lag can result large in time varying loads being applied to the movable wall member 12 (which loads must be overcome by the actuating mechanism in order to accurately control position of the movable wall member 12). Furthermore, the inventors of the present disclosure have realised that this time lag (which represents the time taken to fill or evacuate the cavity 25 to equalise pressure across the balance apertures 32, 33) is dependent on the volume of the cavity 25 which is filled with gas.

Figure 2A:
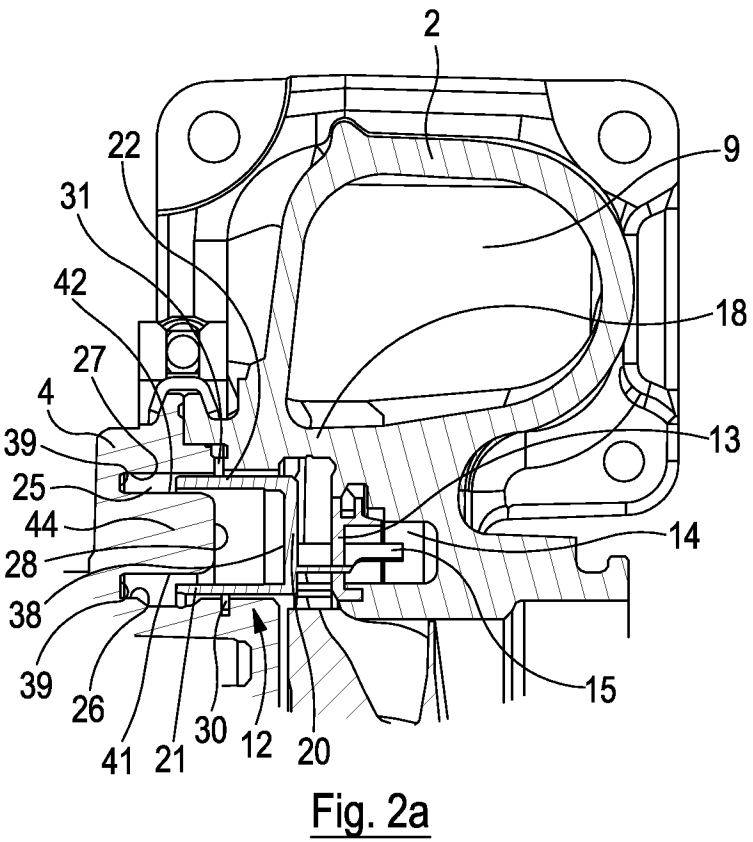
FIG. 2*a* is an enlarged portion of the cross-section shown in FIG. 1, showing details of the movable wall member and cavity according to an embodiment of the present disclosure.

Since the profile shape of the base surface 28 generally matches the profile shape of the interior surface 38 of the movable wall member 12, the volume within the cavity 25 which can be filled with gas is significantly reduced with respect to known arrangements (as can be seen from a comparison of FIGS. 2*a* and 2*b*). In turn, advantageously, this reduces the magnitude of the peak to peak variation in the loads that are applied to the movable wall member 12 and which must be overcome by the actuating mechanism in order to accurately control position of the movable wall member 12.

Figure 5:
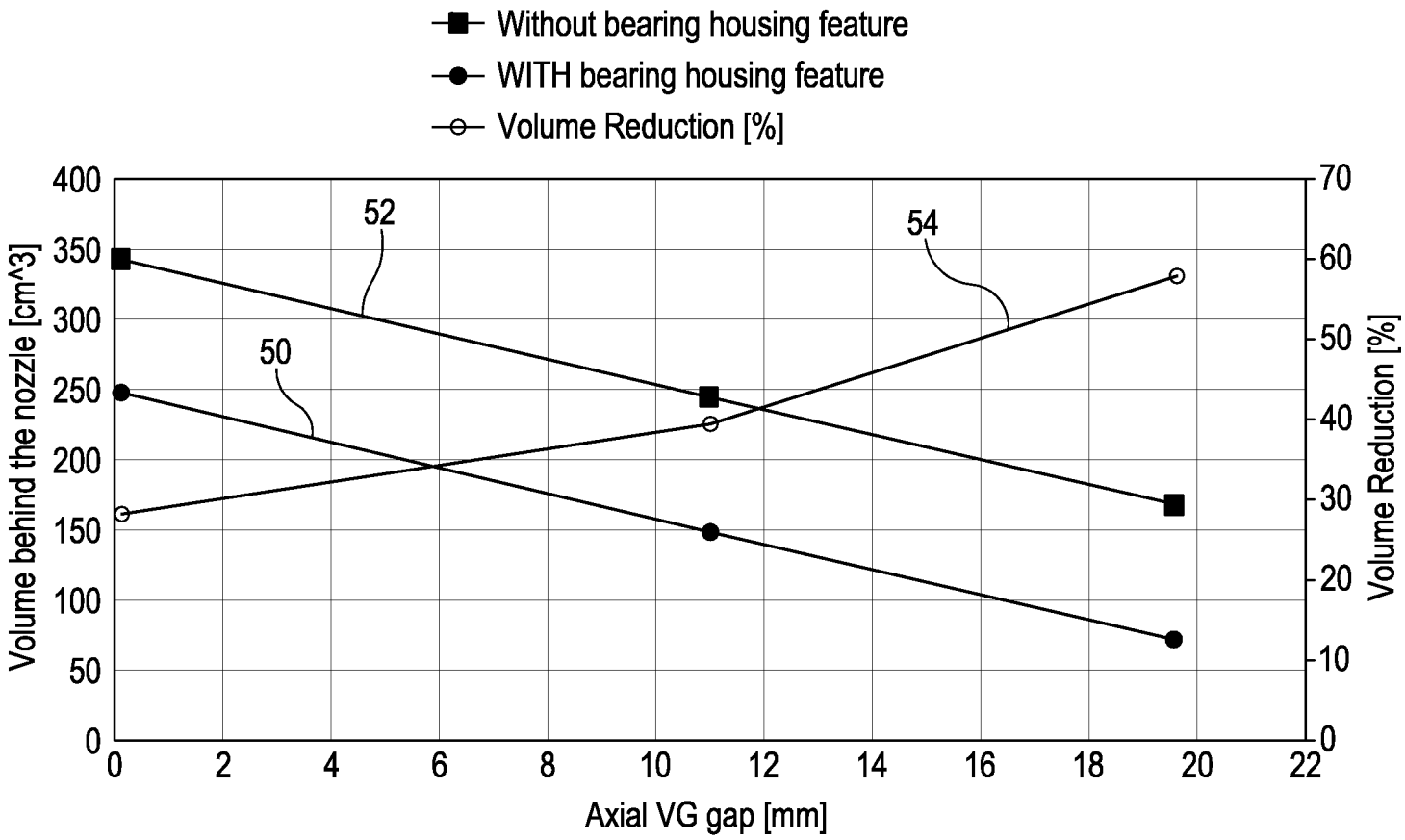
FIG. 5 shows a plot of the volume in the cavity behind the movable wall member as a function of the axial gap between the generally annular wall and the shroud for both: (a) the embodiment shown FIGS. 1, 2*a*, 3*a*, 3*b* and 4*a*; and (b) the known arrangement shown in FIGS. 2*b* and 4*b*, and a plot of the volume reduction (as a percentage) of the cavity relative the known cavity as a function of the axial gap between the generally annular wall and the shroud.

It will be appreciated that although the matching of the profile shape of the base surface 28 to the profile shape of the interior surface 38 of the movable wall member 12 reduces the volume within the cavity 25 which can be filled with gas for a given position of the movable wall member 12, the size of this volume is dependent on the axial position of the movable wall member 12. FIG. 5 shows a plot 50 of the volume in the cavity 25 as a function of the axial gap between the generally annular wall 20 and the shroud 13 for the embodiment described above with reference to FIGS. 1, 2*a*, 3*a*, 3*b* and 4*a*. Also shown in FIG. 5 is a plot 52 of the volume in the cavity 25' as a function of the axial gap between the generally annular wall 20 and the shroud 13 for the known arrangement shown in FIGS. 2*b* and 4*b*. Also shown in FIG. 5 is a plot 54 of the volume reduction (as a percentage) of the cavity 25 (relative the known cavity 25') as a function of the axial gap between the generally annular wall 20 and the shroud 13.

Figure 6A:
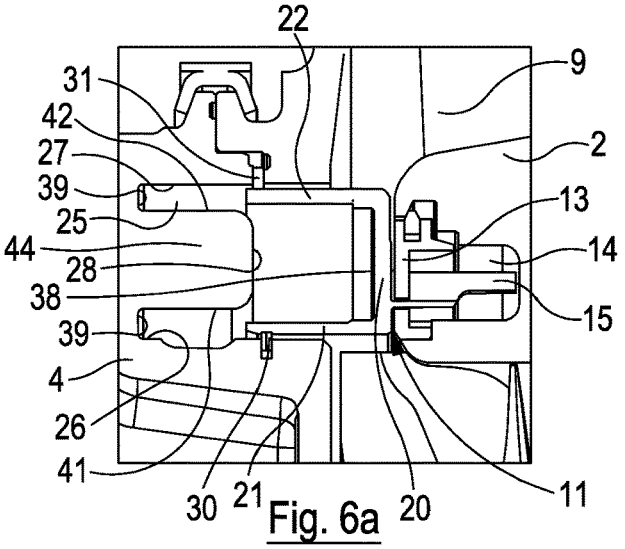
FIG. 6*a* a cross-section showing details of the movable wall member and cavity according to an embodiment of the present disclosure, with the movable wall member disposed in a closed position.
Figure 6B:
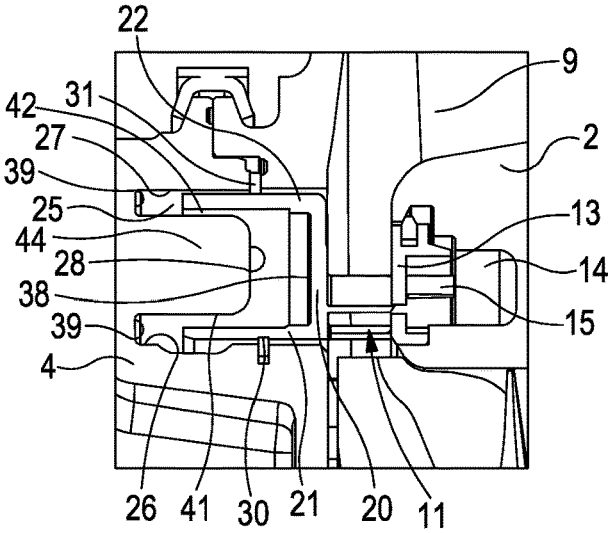
FIG. 6*b* a cross-section showing details of the movable wall member and cavity according to an embodiment of the present disclosure, with the movable wall member disposed between a closed position and an open position.
Figure 6C:
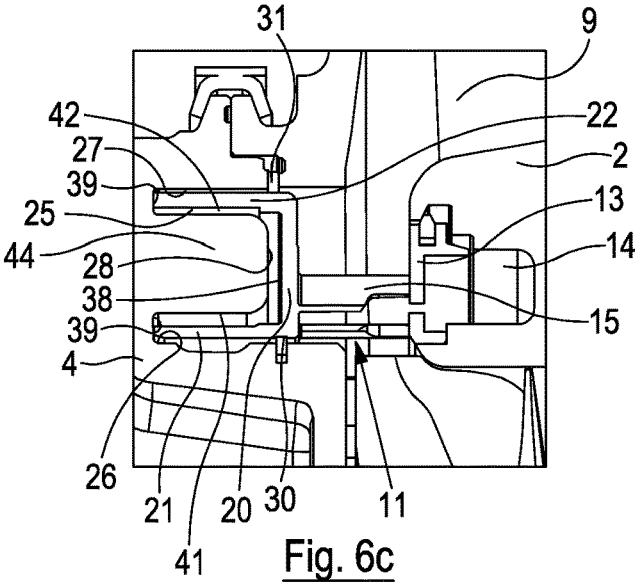
FIG. 6*c* a cross-section showing details of the movable wall member and cavity according to an embodiment of the present disclosure, with the movable wall member disposed in an open position.

The three plots 50, 52, 54 shown in FIG. 5 each show three data points, each one representing a different position of the moveable wall member 12. These three positions are shown in FIGS. 6*a*, 6*b* and 6*c*. The first position (see FIG. 6*a*) represents approximately zero axial gap between the generally annular wall 20 and the shroud 13 and represents a closed position of the moveable wall member 12. The second position (see FIG. 6*b*) represents a position between the closed and open positions of the moveable wall member 12. The third position (see FIG. 6*c*) represents the maximum axial gap between the generally annular wall 20 and the shroud 13 and represents an open position of the moveable wall member 12. In this particular embodiment, when the moveable wall member 12 is disposed in the fully open position, the axial gap between the generally annular wall 20 and the shroud 13 is approximately 19.6 mm.

It can be seen that when the moveable wall member 12 is disposed in the fully open position, the provision of the two arcuate radially central portions 40 reduces the available volume behind the movable wall member 12 by approximately 60%. As the moveable wall member 12 moves towards the fully closed position, the reduction in the available volume behind the movable wall member 12 decreases to approximately 30%.

The variable geometry turbine that forms part of the turbocharger 1 according to an embodiment of the disclosure reduces the magnitude of the time varying loads that are applied to the movable wall member 12 and which must be overcome by the actuating mechanism without adversely affecting the efficiency of the turbine. These effects can be modelled by applying a pressure trace that may be produced in use by an engine (such a pressure trace may, for example, be measured) as boundary conditions in a simulation of the operation of the turbocharger 1.

It will be appreciated that the frequency of exhaust pulses through the variable geometry turbine is dependent on the engine speed. The magnitude of the pulses is dependent on the operating mode of the engine (either fired or braking) and the position of the movable wall member 12. Under braking conditions there is typically a larger pressure drop across the turbine stage (or, equivalently a larger expansion ratio as the exhaust gas moves radially inwards across the face of the generally annular wall member 20). Therefore, generally, a specific set of operating conditions can be characterised by specifying the mode of the engine, the engine speed and the position of the moveable wall member 12.

Figure 7:
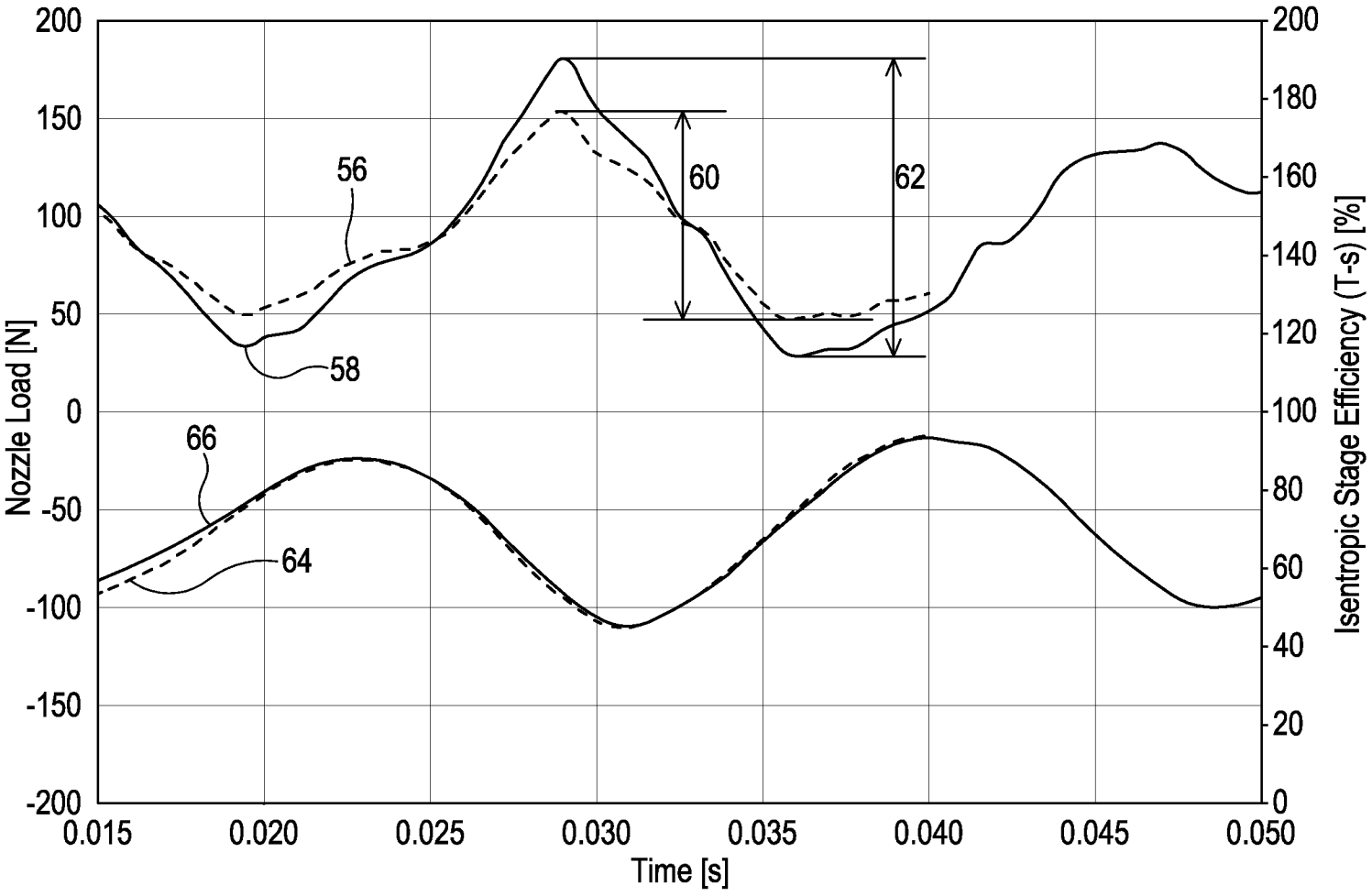
FIG. 7 shows plots of both the load on the movable wall member and the efficiency of the variable turbine as a function of time under specific engine conditions for both: (a) the embodiment shown FIGS. 1, 2*a*, 3*a*, 3*b* and 4*a* (dashed lines); and (b) the known arrangement shown in FIGS. 2*b* and 4*b* (solid lines)

FIG. 7 shows a plot 56 (dashed line) of the load on the movable wall member 12 as a function of time under fired conditions at an engine speed of 1100 rpm, with an axial gap between the generally annular wall 20 and the shroud 13 of 6.19 mm. As can be seen from FIG. 5, an axial gap between the generally annular wall 20 and the shroud 13 of 6.19 mm represents position between the closed and open positions of the moveable wall member 12. Also shown in FIG. 7 is a plot 58 (solid line) of the load on the movable wall member 12 as a function of time under the same conditions (fired conditions at an engine speed of 1100 rpm, with an axial gap between the generally annular wall 20 and the shroud 13 of 6.19 mm) but with the known cavity 25' as shown in FIGS. 2*b* and 4*b*.

It can be seen from FIG. 7 that the magnitude 60 of the time varying loads being applied to the movable wall member 12 (which loads must be overcome by the actuating mechanism in order to accurately control position of the movable wall member 12) for the variable geometry turbine shown in FIG. 2*a* is significantly reduced with respect to the magnitude 62 of the time varying loads being applied to the movable wall member 12 for the known variable geometry turbine shown in FIG. 2*b*. For these specific operating conditions, the magnitude 60 of the time varying loads for the variable geometry turbine shown in FIG. 2*a* is reduced by approximately 30% with respect to the magnitude 62 of the time varying loads being applied to the movable wall member 12 for the known variable geometry turbine shown in FIG. 2*b*.

On the same time scale as for plots 56, 58, FIG. 7 also shows a plot 64 (dashed line) of the efficiency of the variable geometry turbine as a function of time under the same conditions (fired conditions at an engine speed of 1100 rpm, with an axial gap between the generally annular wall 20 and the shroud 13 of 6.19 mm). Also shown in FIG. 7 is a plot 66 (solid line) of the efficiency of the known variable geometry turbine (as shown in FIGS. 2*b* and 4*b*) as a function of time under the same conditions. It can be seen from the efficiency plots 64, 66 shown in FIG. 7 that the arcuate radially central portions 40 no not adversely affect the efficiency of the turbine. In fact, variable geometry turbines according to embodiments of the disclosure can reduce the magnitude of the time varying loads on the movable wall member 12 and, in addition, can even increase the efficiency of the turbine over known arrangements.

In some known arrangements, additional "secondary" balance apertures (i.e. similar to the balance apertures 33 shown in FIGS. 3*a* and 3*b*) are provided upstream of (i.e. at a larger radius than) the primary balance apertures, which are disposed between the vanes 15 (i.e. similar to the balance apertures 32 shown in FIGS. 3*a* and 3*b*) so as reduce the time varying load on the moveable wall member 12. In contrast, the variable geometry turbine according to embodiments of the disclosure do not need such secondary balance apertures 33 and may some embodiments of the disclosure may have no secondary balance apertures 33. Alternatively, the variable geometry turbine embodiments of the disclosure may be provided with fewer such secondary balance apertures 33 than known arrangements. It will be appreciated that such secondary balance apertures 33 represent a leak path within the turbine. Therefore, since the variable geometry turbines according to embodiments of the disclosure do not need such secondary balance apertures 33, or may be provided with fewer such secondary balance apertures 33 than known arrangements, the efficiency of the turbine will be increased relative to such prior art arrangements. In fact, since the profile shape of the base surface 28 generally matches the profile shape of the interior surface 38 of the movable wall member 12, the volume within the cavity 25 which can be filled with gas is significantly reduced with respect to known arrangements. With such a reduced volume within the cavity 25 which can be filled with gas, a smaller total area of the balance apertures 32, 33 can be used with respect to known turbines to achieve the same level of balancing. In turn, this can result in an increase in the efficiency of the turbine with respect to prior art arrangements.

The load on the movable wall member 12 as a function of time has been investigated under a range of different operating conditions (both fired and braking) and compared with the same but with the known cavity 25' as shown in FIGS. 2*b* and 4*b*.

Under fired engine conditions, there was no noticeable effect on the predicted mean load on the movable wall member 12. Under braking engine conditions a small shift in the mean load on the movable wall member 12 was observed over the reduced time period considered for analysis (a limited time-period of high frequency exhaust data was run to reduce the time required for the simulation).

It was found that the peak-to-peak amplitude of the time varying component of the load on the movable wall member 12 was reduced for all cases (both fired and braking) using the modified bearing housing 4. The improvement was more significant for fired mode than braking mode cases. It will be appreciated that under braking conditions the moveable wall member 12 will be positioned such that the axial gap between the generally annular wall 20 and the shroud 13 is relatively small. Furthermore, in such positions, the reduction in the total volume behind the movable wall member 12 is relatively small (see, for example, FIG. 5). However, the reduction in the improvement for braking mode cases relative to fired mode cases is greater than one might expect from the change in geometry alone. It is thought that there may be an additional reduction in the effectiveness due to the increased pressure difference (or expansion ratio) experienced across the turbine stage during braking mode operation.

In order to investigate this, the reduction factor of the amplitude of the time varying component of the load on the movable wall member 12 has been studied as a function of the volume reduction (relative to the known arrangement shown in FIGS. 2*b*, 4*b*). It will be appreciated that the volume reduction can be varied either by varying the position of the movable wall member 12 or by altering its geometry.

Figure 8:
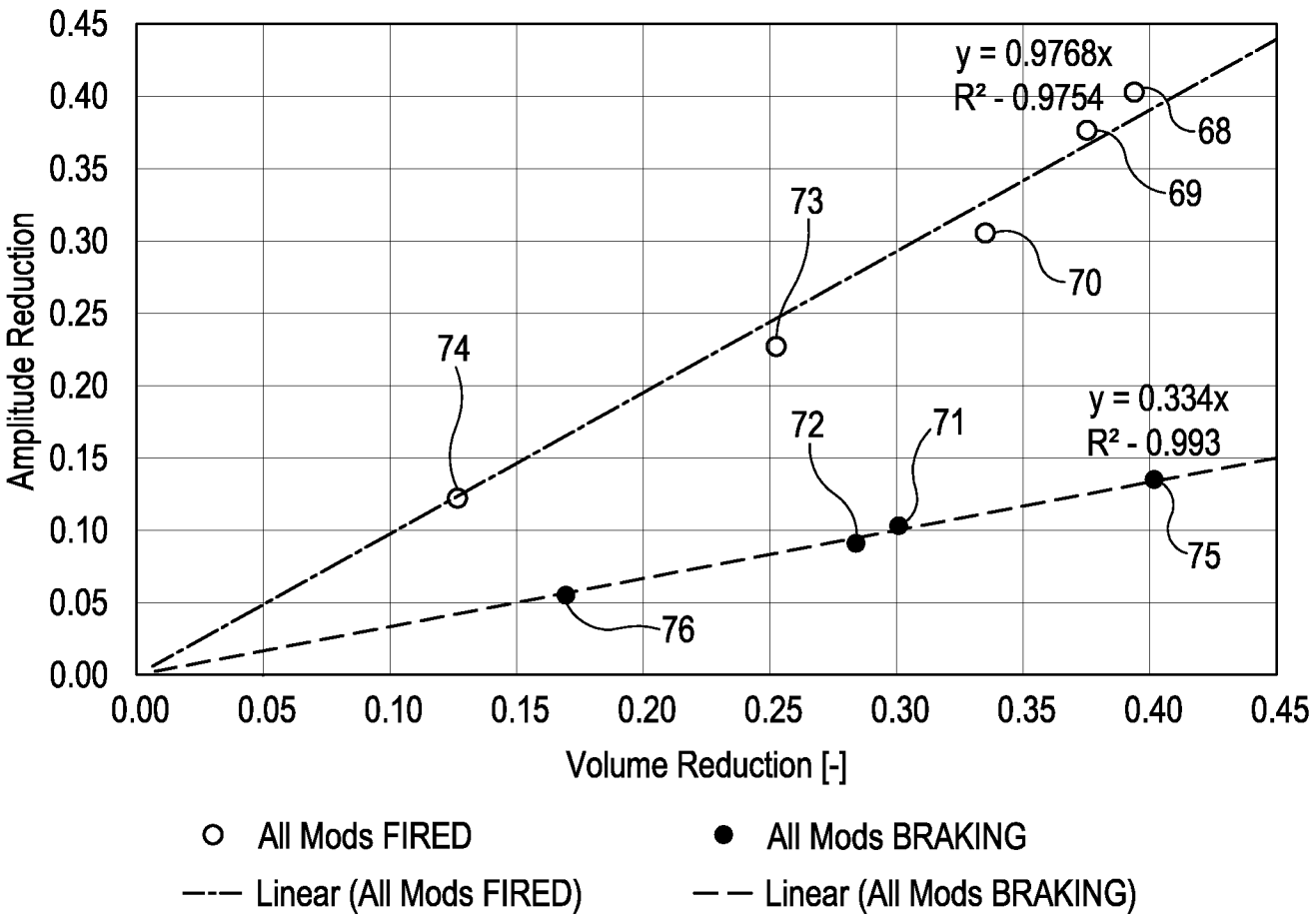
FIG. 8 shows the reduction factor of the amplitude of the time varying component of the load on the movable wall member plotted against the volume reduction (relative to the known arrangement shown in FIGS. 2*b*, 4*b*) for 9 different points in the space of operating conditions and geometry of the base wall.

FIG. 8 shows the reduction factor of the amplitude of the time varying component of the load on the movable wall member 12 plotted against the volume reduction (relative to the known arrangement shown in FIGS. 2*b*, 4*b*) for 9 different points in the space of operating conditions and geometry of the base wall 28.

Five of the points 68, 69, 70, 71, 72 correspond to the same geometry as discussed above but for different operating conditions. Three of these points 68, 69, 70 correspond to fired conditions but with different positions of the movable wall member 12. Point 68 corresponds to fired conditions at an engine speed of 1950 rpm, with an axial gap between the generally annular wall 20 and the shroud 13 of 10.93 mm; point 69 corresponds to fired conditions at an engine speed of 1700 rpm, with an axial gap between the generally annular wall 20 and the shroud 13 of 9.58 mm; and point 70 corresponds to fired conditions at an engine speed of 1100 rpm, with an axial gap between the generally annular wall 20 and the shroud 13 of 6.19 mm. Two of these points 71, 72 correspond to braking conditions but with different positions of the movable wall member 12. Point 71 corresponds to braking conditions at an engine speed of 2200 rpm, with an axial gap between the generally annular wall 20 and the shroud 13 of 2.55 mm; and point 72 corresponds to braking conditions at an engine speed of 1800 rpm, with an axial gap between the generally annular wall 20 and the shroud 13 of 0.414 mm The remaining points 73, 74, 75, 76 correspond to modified geometries of the base surface 28, with the arcuate radially central portions 40 being either smaller or larger in axial extent than the geometry discussed above.

Point 73 corresponds to the same operating conditions as point 70 but with the arcuate radially central portions 40 being smaller in axial extent. Similarly, point 74 corresponds to the same operating conditions as point 69 but with the arcuate radially central portions 40 being smaller in axial extent. Point 75 corresponds to the same operating conditions as point 71 but with the arcuate radially central portions 40 being larger in axial extent. Similarly, point 76 corresponds to the same operating conditions as point 71 but with the arcuate radially central portions 40 being smaller in axial extent.

It can be seen from FIG. 8 that the amplitude of the time varying component of the load on the movable wall member 12 was reduced in all cases. The points 68, 69, 70, 73, 74 that correspond to fired conditions follow a first trend that the reduction factor of the amplitude of the time varying component of the load on the movable wall member 12 is proportional to the volume reduction (relative to the known arrangement shown in FIGS. 2*b*, 4*b*). The points 71, 72, 75, 76 that correspond to braking conditions follow a second trend that the reduction factor of the amplitude of the time varying component of the load on the movable wall member 12 is proportional to the volume reduction (relative to the known arrangement shown in FIGS. 2*b*, 4*b*). It can be seen from these two trends that the improvement is more significant for fired mode conditions than for braking mode conditions.

It will be appreciated that for a profile shape of the base surface 23 of the cavity 25 in the housing of the variable geometry turbine to generally match a profile shape of the interior surface 38 of the movable wall member 12, the profile shape of the base surface 23 of the cavity 25 should be generally complementary to the profile shape of the interior surface 38 of the movable wall member 12. It will be appreciated that two shapes may generally match, or be generally complementary, if one shape is generally concave and the other shape is generally convex and the convex shape can be partially received within the concave shape.

In the above described embodiments the matching of the profile shape of the base surface 23 of the cavity 25 in the housing to the profile shape of the interior surface 38 of the movable wall member 12, is achieved by providing axial protrusions 40 from the base surface 23 of the cavity 25 that are received in, and generally match, an interior of the movable wall member 12. However, it will be appreciated that in additionally or alternatively, in some embodiments the shape of the interior of the movable wall member 12 may be modified to match the profile of the base surface 23 of the cavity 25.

It will be appreciated that the bearing housing 4 and the movable wall member 12 are both formed from materials that are impermeable to gas flow. For example, the bearing housing 4 and the movable wall member 12 may both be formed from steel. In particular, arcuate radially central portions 40, which are of the form of axial protrusions from a generally flat portion 39 of the base surface 28 at an axial end surface of the bearing housing 4, are formed from a material that is impermeable to gas flow (for example steel). It will be appreciated that the arcuate radially central portions 40, may be integrally formed with the bearing housing 4. For example, they may be formed therewith during a casting process. Optionally, they may be at least partially formed by a machining process following a casting process. It will be appreciated that the reduction in the amplitude of the time varying loads that are applied to the movable wall member 12 is achieved by reducing the available volume behind the movable wall member 12 in which gas can flow. It is known to provide a filter material in the cavity behind the movable wall member 12 that can capture particulate matter entrained with exhaust gases flowing through the turbine of a variable geometry turbocharger and can facilitate the oxidation of such particulate matter to (gaseous) carbon dioxide and water. However, such filter materials are permeable to fluid flow and may, for example, comprise a mesh of wire. Due to the low density of such wire mesh materials, they typically do not significantly reduce the available volume that can receive exhaust gases and therefore would not enjoy any significant reduction in the amplitude of time varying loads on the movable wall member 12.

It will be appreciated that it is desirable to reduce the available volume behind the moveable wall member 12 that can support exhaust gases as much as possible. Preferably, the shape of the base surface 23 of the cavity 25 in the housing of the variable geometry turbine and the profile shape of the interior surface 38 of the movable wall member 12 are such that at the volume of the cavity is reduced by at least 20% relative to an arrangement wherein the base surface 23 of the cavity and the interior surface of the generally annular wall 20 are both flat (as in FIG. 2*b*). More preferably, the shape of the base surface 23 of the cavity 25 in the housing of the variable geometry turbine and the profile shape of the interior surface 38 of the movable wall member 12 are such that at the volume of the cavity is reduced by at least 30% relative to an arrangement wherein the base surface 23 of the cavity and the interior surface of the generally annular wall 20 are both flat (as in FIG. 2*b*). More preferably, the shape of the base surface 23 of the cavity 25 in the housing of the variable geometry turbine and the profile shape of the interior surface 38 of the movable wall member 12 are such that at the volume of the cavity is reduced by at least 40% relative to an arrangement wherein the base surface 23 of the cavity and the interior surface of the generally annular wall 20 are both flat (as in FIG. 2*b*). More preferably, the shape of the base surface 23 of the cavity 25 in the housing of the variable geometry turbine and the profile shape of the interior surface 38 of the movable wall member 12 are such that at the volume of the cavity is reduced by at least 50% relative to an arrangement wherein the base surface 23 of the cavity and the interior surface of the generally annular wall 20 are both flat (as in FIG. 2*b*). More preferably, the shape of the base surface 23 of the cavity 25 in the housing of the variable geometry turbine and the profile shape of the interior surface 38 of the movable wall member 12 are such that at the volume of the cavity is reduced by at least 60% relative to an arrangement wherein the base surface 23 of the cavity and the interior surface of the generally annular wall 20 are both flat (as in FIG. 2*b*).

According to an embodiment of the present disclosure there is provided a method of forming a variable geometry turbine substantially as described above with reference to the turbocharger 1 of FIGS. 1, 2*a*, 3*a*, 3*b* and 4*a*. In particular, embodiments of the present disclosure may relate to methods of forming the cavity 25 and/or the part of the bearing housing that defines the cavity 25 (i.e. the bearing housing 4). The method may further comprise mounting a movable wall member 12 in the cavity 25 of the housing 4 such that the movable wall member is axially movable relative to the housing.

In some embodiments, the bearing housing 4 may be cast with the cavity 25 having a base surface 28 as described above. For example, the entire base surface 28, including the the arcuate radially central portions 40 may be formed by such a casting process.

The method of forming the bearing housing 4 may further comprise machining the casting to form at least a part of the cavity 25. For example, the casting may not define the cavity 25 or, alternatively, may only partially define the cavity 25. Additional machining steps (for example milling) may be used to define, or further define, the cavity 25 having a suitable profile shape.

Additionally or alternatively, the method of forming the bearing housing 4 may further comprise attaching to the casting one or more additional members, the one or more additional members contributing to the profile shape of the base surface of the cavity. For example, the casting may form a cavity having a base surface which has a profile shape that does not match the profile shape of the interior surface 38 of the movable wall member 12 and one or more additional members may be attached (for example via bolts, screws, rivets or any other suitable fastener) to alter the shape of the base surface of the cavity such that it does substantially match the profile shape of the interior surface 38 of the movable wall member 12. For example, a casting process may be used to form a cavity 25' having a generally flat base surface 28' (i.e. as shown in FIG. 2*b*). Subsequently, additional filler members may be attached to this flat base surface 28'. For example, the additional filler members may be generally of the form of the arcuate radially central portions 40 described above. It will be appreciated that each such arcuate radially central portion 40 may be formed from a plurality of additional members that are attached to a casting.

While specific embodiments of the disclosure have been described above, it will be appreciated that the disclosure may be practiced otherwise than as described. The descriptions above are intended to be illustrative, not limiting. Thus it will be apparent to one skilled in the art that modifications may be made to the disclosure as described without departing from the scope of the claims set out below.

The invention claimed is:

1. A variable geometry turbine comprising:

a housing;

a turbine wheel supported in the housing for rotation about an axis;

a movable wall member comprising a generally annular wall and radially inner and outer flanges extending axially from the generally annular wall;

a cavity provided in the housing for receipt of the radially inner and outer flanges of the movable wall member, the movable wall member being axially movable relative to the housing to vary the extent to which the radially inner and outer flanges of the movable wall member are received in the cavity, the cavity being defined by radially inner and outer curved side surfaces and a base surface extending between the radially inner and outer curved side surfaces;

an inlet passageway extending radially inwards towards the turbine wheel and defined between a face of the generally annular wall of the movable wall member and an opposing wall of the housing, such that said axial movement of the movable wall member relative to the housing varies the axial width of the inlet passageway; and a plurality of axially extending apertures provided through the generally annular wall of the movable wall member, such that the inlet and the cavity are in fluid communication via the plurality of apertures;

wherein the base surface of the cavity comprises at least one arcuate radially central portion which is shaped so as to be received in an interior of the movable wall member when it is disposed in a fully open position;

wherein each arcuate radially central portion is of the form of an axial protrusion from a generally flat portion of the base surface; and wherein each arcuate radially central portion extends circumferentially generally between second apertures that a support of the movable wall member extends through.

2. The variable geometry turbine of claim 1 wherein the interior surface of the movable wall member is at least partially defined by inner surfaces of the generally annular wall and the radially inner and outer flanges.

3. The variable geometry turbine of claim 1 wherein the movable wall member further comprises at least one support.

4. The variable geometry turbine of claim 3 wherein the interior surface of the movable wall member is at least partially defined by said at least one support and any connecting members or connecting portions of said at least one support.

5. The variable geometry turbine of claim 1 wherein at least part of the base surface of the cavity and at least part of the interior surface of the movable wall member is not flat.

6. The variable geometry turbine of claim 1 wherein one of the base surface of the cavity and the interior surface of the movable wall member is at least partially generally concave and the other is at least partially generally convex, and wherein the generally convex surface can be partially received within the generally concave surface.

7. The variable geometry turbine of claim 1 wherein each arcuate radially central portion comprises, along a circumferential extent of the arcuate radially central portions, two end portions and a central portion disposed therebetween, an axial extent of the central portion being greater than an axial extent of the two end portions.

8. The variable geometry turbine of claim 7 wherein adjacent end portions of two arcuate radially central portions are separated by a second aperture through which a support of the movable wall member extends and wherein the reduced axial extent of two end portions relative to the central portion forms a void that accommodates a connecting member or portion of said support.

9. The variable geometry turbine of claim 1 wherein the movable wall member supports an array of circumferentially spaced inlet vanes each of which extends across the inlet passageway.

10. The variable geometry turbine of claim 9 wherein at least some of the axially extending apertures provided through the generally annular wall of the movable wall member are located between the inlet vanes.

11. The variable geometry turbine of claim 1 wherein the movable wall member is movable between a fully open position and a fully closed position and wherein when disposed in the fully open position part of the movable wall member contacts part of the base surface of the cavity.

12. The variable geometry turbine of claim 1 wherein the base surface of the cavity and the interior surface of the movable wall member are formed from materials that are impermeable to gas flow.

13. The variable geometry turbine of claim 1 wherein the shape of the base surface of the cavity and the profile shape of the interior surface of the movable wall member are such that the volume of the cavity is reduced by at least 20% relative to an arrangement wherein the base surface of the cavity and the interior surface of the generally annular are both flat.

14. A turbocharger comprising the variable geometry turbine of claim 1.

15. A method of forming a variable geometry turbine comprising:

providing a movable wall member comprising a generally annular wall and radially inner and outer flanges extending axially from the generally annular wall;

providing a housing having a cavity for receipt of the radially inner and outer flanges of the movable wall member, the cavity being defined by radially inner and outer curved side surfaces and a base surface extending between the radially inner and outer curved side surfaces;

mounting the movable wall member in the cavity of the housing such that the movable wall member is axially movable relative to the housing to vary the extent to which the radially inner and outer flanges of the movable wall member are received in the cavity; and mounting a turbine wheel in the housing for rotation about an axis, such that a face of the generally annular wall of the movable wall member and an opposing wall of the housing define an inlet passageway extending radially inwards towards the turbine wheel;

wherein a plurality of axially extending apertures are provided through the generally annular wall of the movable wall member, such that the inlet and the cavity are in fluid communication via the plurality of apertures;

wherein the base surface of the cavity comprises at least one arcuate radially central portion which is shaped so as to be received in an interior of the movable wall member when it is disposed in a fully open position;

wherein each arcuate radially central portion is of the form of an axial protrusion from a generally flat portion of the base surface; and wherein each arcuate radially central portion extends circumferentially generally between second apertures that a support of the movable wall member extends through.

16. The method of claim 15 wherein providing the housing having the cavity comprises casting a part of the housing on which the cavity is formed.

17. The method of claim 16 wherein providing the housing having the cavity further comprises machining the casting to form at least a part of the cavity.

18. The method of claim 16 wherein providing the housing having the cavity further comprises attaching to the casting one or more additional members, the one or more additional members contributing to the profile shape of the base surface of the cavity.

* * * * *